US011355255B2

(12) United States Patent
Park et al.

(10) Patent No.: US 11,355,255 B2
(45) Date of Patent: Jun. 7, 2022

(54) SYSTEM AND METHOD FOR REDUCING ATMOSPHERIC RELEASE OF RADIOACTIVE MATERIALS CAUSED BY SEVERE ACCIDENT

(71) Applicant: Korea Atomic Energy Research Institute, Daejeon (KR)

(72) Inventors: Joo-Hwan Park, Daejeon (KR); Sung Il Kim, Daejeon (KR); Kwang Soon Ha, Daejeon (KR); Byeong Hee Lee, Gyeonggi-do (KR)

(73) Assignee: Korea Atomic Energy Research Institute, Daejeon (KR)

( * ) Notice: Subject to any disclaimer, the term of this patent is extended or adjusted under 35 U.S.C. 154(b) by 67 days.

(21) Appl. No.: 16/749,872

(22) Filed: Jan. 22, 2020

(65) Prior Publication Data

US 2020/0234836 A1 Jul. 23, 2020

(30) Foreign Application Priority Data

Jan. 22, 2019 (KR) ..... 10-2019-0008072
Apr. 10, 2019 (KR) ..... 10-2019-0041801
Dec. 30, 2019 (KR) ..... 10-2019-0177364

(51) Int. Cl.
*G21D 3/04* (2006.01)
*G21D 1/02* (2006.01)
(Continued)

(52) U.S. Cl.
CPC ..... *G21D 3/04* (2013.01); *F28B 9/06* (2013.01); *G21C 9/004* (2013.01); *G21C 13/022* (2013.01);
(Continued)

(58) Field of Classification Search
CPC ..... G21C 9/004; G21C 9/008; G21C 9/012; G21C 9/00; G21C 9/06; G21C 9/033;
(Continued)

(56) References Cited

U.S. PATENT DOCUMENTS 4,687,626 A * 8/1987 Tong ..... F22B 37/42 376/298
11,107,593 B2 * 8/2021 Hill ..... G21C 9/012
2011/0158371 A1 * 6/2011 Sato ..... G21C 1/086 376/249
2013/0028365 A1 * 1/2013 Tatli ..... G21H 3/00 376/272
(Continued)

FOREIGN PATENT DOCUMENTS

JP 2016-014640 1/2016
KR 10-2012-0115753 10/2012
(Continued)

*Primary Examiner* — Darlene M Ritchie
(74) *Attorney, Agent, or Firm* — Morrison & Foerster, LLP

(57) ABSTRACT

Provided are a system and method for reducing the atmospheric release of radioactive materials caused by a severe accident. The system includes a steam generator disposed in a containment building, configured to generate steam by using heat of a coolant heated in a nuclear reactor, and connected to a turbine through a main steam line, a decontamination tank connected to the main steam line through a connection line and containing decontamination water for decontaminating the steam delivered from the steam generator and reducing atmospheric release of radioactive materials when a severe accident occurs, and a depressurizing power generation unit disposed on the connection line and configured to generate emergency power while depressurizing the steam delivered from the steam generator toward the decontamination tank when the severe accident occurs.

11 Claims, 4 Drawing Sheets

(51) Int. Cl.

| | |
|---|---|
| ***G21C 15/12*** | (2006.01) |
| ***G21C 15/18*** | (2006.01) |
| ***G21C 13/02*** | (2006.01) |
| ***G21C 9/004*** | (2006.01) |
| ***F28B 9/06*** | (2006.01) |

(52) U.S. Cl.
CPC ..... *G21C 15/12* (2013.01); *G21C 15/18* (2013.01); *G21C 15/185* (2019.01); *G21D 1/02* (2013.01)

(58) Field of Classification Search
CPC .... G21C 13/022; G21C 13/024; G21C 15/12; G21C 15/18; G21C 15/185; G21D 5/00; G21D 5/04; G21D 5/08; G21D 1/006; G21D 1/02; G21D 3/004; F28B 9/06; Y02E 30/30; Y02E 30/00; G21F 9/00
USPC ..... 376/283, 309, 317
See application file for complete search history.

(56) References Cited

U.S. PATENT DOCUMENTS

| | | | | |
|---|---|---|---|---|
| 2015/0033742 | A1* | 2/2015 | Herrazti Garcia | F01K 3/183 60/653 |
| 2015/0221403 | A1* | 8/2015 | Kim | G21C 9/004 376/203 |
| 2017/0162281 | A1* | 6/2017 | Sato | G21C 9/004 |
| 2017/0176315 | A1* | 6/2017 | Sakata | G21C 15/182 |
| 2017/0291847 | A1* | 10/2017 | Fritz | H01B 17/305 |
| 2018/0053571 | A1* | 2/2018 | Graham | G21C 15/185 |

FOREIGN PATENT DOCUMENTS

| | | | | |
|---|---|---|---|---|
| KR | 10-2013-0137617 | | 12/2013 | |
| KR | 10-2014-0054266 | | 5/2014 | |
| KR | 10-1553892 | | 9/2015 | |
| KR | 10-2016-0142164 | | 12/2016 | |
| KR | 20160142164 | A * | 12/2016 | G21C 15/18 |
| KR | 10-1905724 | | 10/2018 | |

* cited by examiner

SYSTEM AND METHOD FOR REDUCING ATMOSPHERIC RELEASE OF RADIOACTIVE MATERIALS CAUSED BY SEVERE ACCIDENT

CROSS-REFERENCE TO RELATED APPLICATION

This application claims priority to and the benefit of Korean Patent Application No. 10-2019-0008072, filed on 22 Jan. 2019, Korean Patent Application No. 10-2019-0041801, filed on 10 Apr. 2019, and Korean Patent Application No. 10-2019-0177364, filed on 30 Dec. 2019, the disclosures of which are incorporated herein by reference in their entirety.

BACKGROUND

1. Field of the Invention

The present disclosure relates to a system and method for reducing the atmospheric release of radioactive materials caused by a severe accident, the system and method capable of reducing in which radioactive materials is released into the atmosphere by bypassing a containment building when a severe accident occurs in a nuclear power plant.

2. Discussion of Related Art

After the Fukushima nuclear power plant accident, each individual country strengthens regulations to ensure the capability of dealing with a severe accident in a nuclear power plant which has been running as well as an advanced light water reactor.

When a severe accident occurs, the most important countermeasure for preventing the release of radioactive materials is an effort to ensure the integrity of a containment building. To this end, after the Fukushima accident, various follow-up measures, such as mobile diesel generation power, installation of a waterproof floodgate, and installation of filtered venting equipment, were taken for nuclear power plants which are in operation or under construction. Due to these measures, safety of nuclear power plants was remarkably improved. However, when a steam generator tube rupture (SGTR) or an interfacing-system loss-of-coolant-accident (ISLOCA), which is an event resulting from a severe accident, occurs, radioactive materials bypass the containment building and are released to the atmosphere even if the integrity of the containment building is ensured. Consequently, an SGTR and an ISLOCA still remain as important issues in terms of safety of a nuclear reactor.

SUMMARY OF THE INVENTION

The present invention is directed to providing a system and method for reducing the atmospheric release of radioactive materials caused by a severe accident, the system and method capable of reducing an accident in which radioactive materials is released into the atmosphere by bypassing a containment building when a severe accident occurs.

According to an aspect of the present invention, there is provided a system for reducing the atmospheric release of radioactive materials caused by a severe accident, the system including a steam generator disposed in a containment building, configured to generate steam by using heat of a coolant heated in a nuclear reactor, and connected to a turbine through a main steam line; a decontamination tank connected to the main steam line through a connection line and containing decontamination water for decontaminating the steam delivered from the steam generator and reducing atmospheric release of radioactive materials when a severe accident occurs; and a depressurizing power generation unit disposed on the connection line and configured to generate emergency power while depressurizing the steam delivered from the steam generator toward the decontamination tank when the severe accident occurs.

According to another aspect of the present invention, there is provided a method of reducing the atmospheric release of radioactive materials caused by a severe accident, the method including: generating emergency power by using steam, which is delivered from a steam generator disposed in a containment building to a decontamination tank containing decontamination water, while depressurizing the steam; and delivering the steam, which has been depressurized through the generating of the emergency power, to the decontamination tank and decontaminating the depressurized steam through the decontamination water. The generating of the emergency power by using the steam while depressurizing the steam is performed by a turbine disposed on a connection line connected to a main steam line which connects another turbine for nuclear power generation and the steam generator.

According to one embodiment of the present invention, when a severe accident occurs, it is possible to prevent the internal pressure of a decontamination tank from instantaneously rising due to high-temperature and high-pressure steam delivered toward the decontamination tank. Accordingly, the present invention can improve the performance and safety of the decontamination tank.

Also, according to one embodiment of the present invention, it is possible to both depressurize steam supplied toward a decontamination tank and generate emergency power through a depressurizing power generation unit. Accordingly, even when a severe accident occurs, the emergency power generated through the depressurizing power generation unit may be supplied as drive power to electrical equipment which uses electricity. Consequently, even when a severe accident occurs, it is possible to improve the stability of the nuclear power plant because the state of a nuclear power plant is checked through driving the electrical equipment.

Further, according to one embodiment of the present invention, a decontamination tank may be disposed in a containment building to remove radioactive materials from steam flowing in from a steam generator when a severe accident occurs. Accordingly, even when the decontamination tank is partially damaged due to an instantaneous rise in pressure and radioactive materials leak out, the radioactive materials may be released into the containment building and thus fundamentally prevented from being released to the outside. Consequently, the present invention can fundamentally prevent an accident in which radioactive materials is released into the atmosphere by bypassing a containment building when a severe accident occurs, thus improving the safety of a nuclear power plant further.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
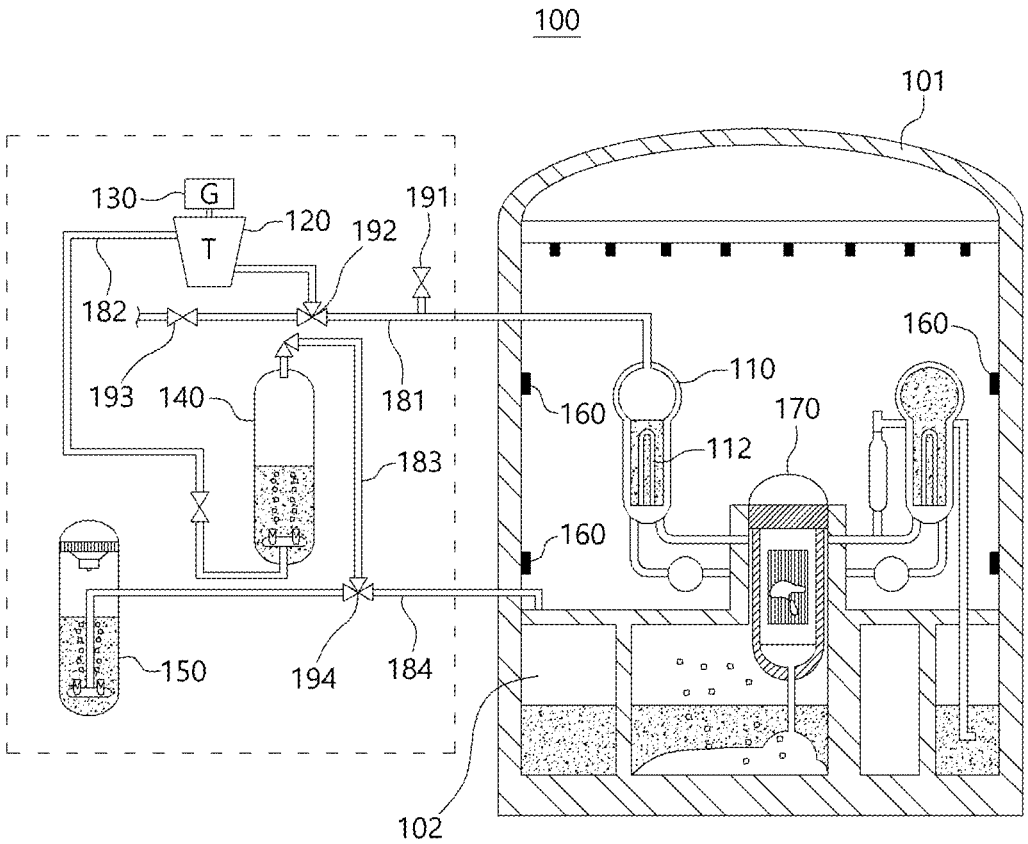
FIG. 1 is a schematic diagram of a system for reducing the atmospheric release of radioactive materials caused by a severe accident according to one embodiment of the present invention.

Hereinafter, exemplary embodiments of the present invention will be described in detail so that those of ordinary skill in the art can readily implement the present invention. The present invention may be embodied in many different forms and are not limited to the embodiments set forth herein. In the drawings, parts unrelated to the description are omitted for clarity. Throughout the specification, like reference numerals denote like elements.

Figure 2:
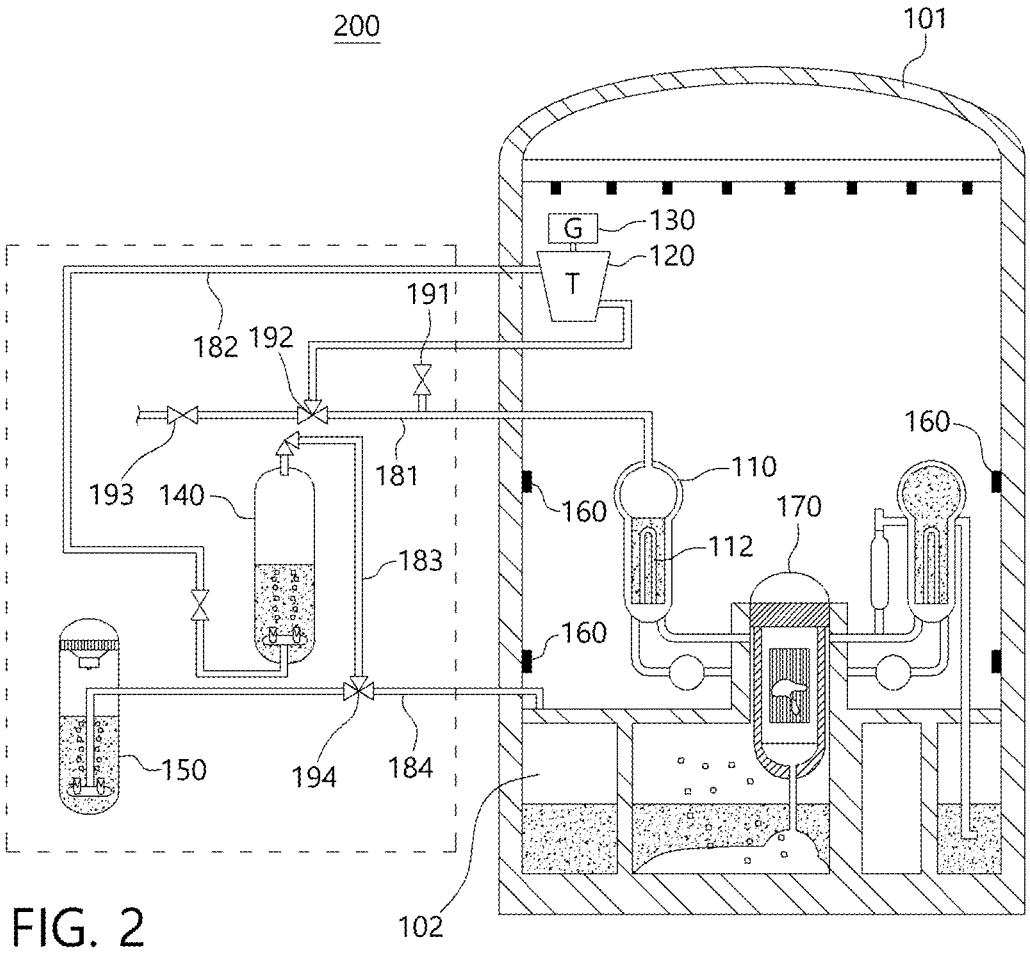
FIG. 2 is a schematic diagram of a system for reducing the atmospheric release of radioactive materials caused by a severe accident according to another embodiment of the present invention.
Figure 3:
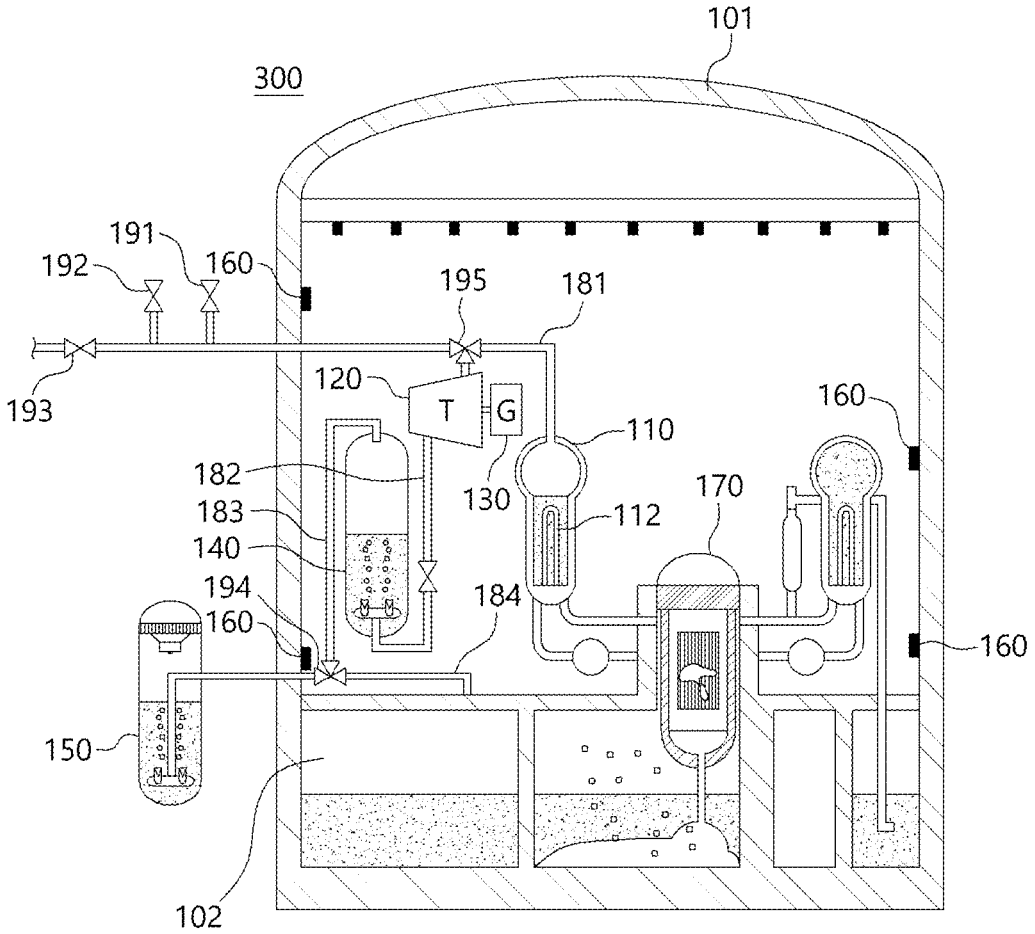
FIG. 3 is a schematic diagram of a system for reducing the atmospheric release of radioactive materials caused by a severe accident according to still another embodiment of the present invention.

Systems 100, 200, and 300 for reducing the atmospheric release of radioactive materials caused by a severe accident according to one embodiment of the present invention include a steam generator 110, a decontamination tank 140, and depressurizing power generation unit 120 and 130 as shown in FIGS. 1 to 3.

The steam generator 110 may be disposed in a containment building 101 and generate steam for nuclear power generation and then supply the steam to a turbine (not shown). In other words, the steam generator 110 may be connected to the turbine through a main steam line 181 to supply the steam to the turbine.

In this case, one or more valves may be provided on the main steam line 181 to perform various functions, such as permitting the flow of steam, blocking the flow of steam, and discharging steam.

For example, the one or more valves may include a main steam safety valve (MSSV) 192 for preventing excessive pressure of the main steam line 181, a main steam isolation valve (MSIV) 193 for isolating the steam generator 110 to prevent a nuclear reactor coolant system from being excessively cooled by discharging steam when the main steam line 181 is damaged, and the like.

Also, the one or more valves may further include an atmospheric dump valve (ADV) 191 for cooling the nuclear reactor coolant system by directly discharging excess steam to the atmosphere when the steam generator 110 is isolated, the turbine is stopped, or a condenser loses its function. However, the types and the number of valves are not limited thereto and may appropriately vary depending on design conditions.

Steam generated by the steam generator 110 may pass through the one or more valves and may be collected in one main steam common header and then supplied to the turbine.

Here, the main steam safety valve 192 may be automatically opened when a steam pressure reaches a set value, and the atmospheric dump valve 191 may be manually manipulated in a main control room or a remote shutdown panel.

In the containment building 101, a nuclear reactor 170 for heating a coolant and supplying the heated coolant to the steam generator 110, the steam generator 110 for generating steam by using the heat of the coolant supplied from the nuclear reactor 170, etc. may be disposed. In addition, an in-containment refueling water storage tank 102 for supplying nuclear fuel to the nuclear reactor 170 may be provided in the containment building 101. Such an internal structure of the containment building 101 is well known, and thus detailed description thereof is omitted.

The decontamination tank 140 may decontaminate steam delivered from the steam generator 110 when a severe accident, such as the rupture of a tube 112 in the steam generator 110, occurs. Accordingly, when a severe accident occurs, the amount of radioactive materials directly released to the atmosphere may be reduced because radioactive materials are removed from steam generated by the steam generator 110 through decontamination.

To this end, the decontamination tank 140 may be filled with decontamination water 141 for decontaminating the steam, and the decontamination tank 140 may be connected to the main steam line 181 through a connection line 182.

For example, one end of the connection line 182 may be connected to the decontamination tank 140, and the other end may be connected to the main steam safety valve 192 or an atmospheric release reduction valve 195 installed on the main steam line 181. In this case, the main steam safety valve 192 or the atmospheric release reduction valve 195 may be provided as a three-way valve.

Accordingly, during normal operation, high-pressure steam generated by the steam generator 110 is supplied to the turbine along the main steam line 181 so that power may be generated. Also, when a design basis accident occurs, high-pressure steam generated by the steam generator 110 may be discharged to the atmosphere through the atmospheric dump valve 191. Also, when a severe accident occurs, high-pressure steam generated by the steam generator 110 may be delivered to the decontamination tank 140 through the connection line 182.

For this reason, when a severe accident occurs, radioactive materials included in the high-pressure steam may be decontaminated through the decontamination water 141 in the decontamination tank 140. Accordingly, the atmospheric release of radioactive materials included in the high-pressure steam may be reduced.

Here, the severe accident may be a bypass accident related to the containment building 101 such as a rupture of the tube 112 in the steam generator 110 (a steam generator tube rupture (SGTR)) or an interfacing-system loss-of-coolant-accident (ISLOCA).

Figure 4:
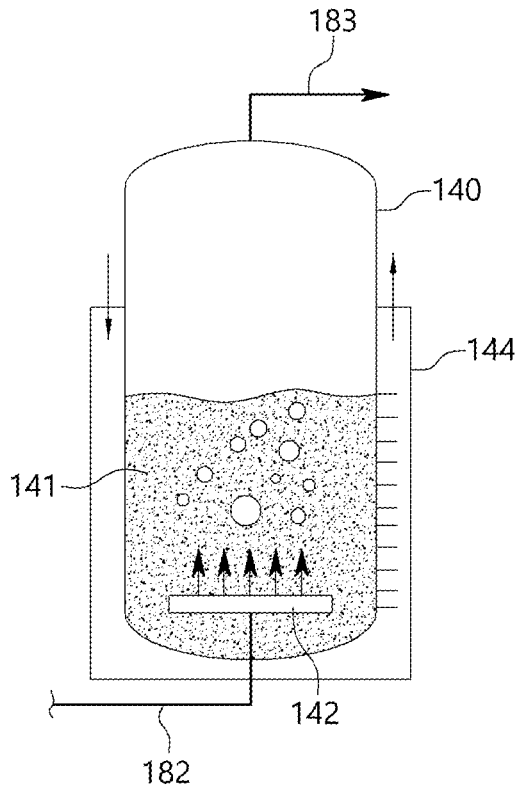
FIG. 4 is a diagram showing a detailed configuration of a decontamination tank which may be applied to a system for reducing the atmospheric release of radioactive materials caused by a severe accident according to one embodiment of the present invention.

In the systems 100, 200, and 300 for reducing the atmospheric release of radioactive materials caused by a severe accident according to one embodiment of the present invention, the connection line 182 may be connected to a lower portion of the decontamination tank 140, and at least one nozzle 142 may be provided at an end of the connection line 182 (see FIG. 4).

Here, the nozzle 142 may be disposed so that a lower end portion of the nozzle 142 may be located in the decontamination tank 140. Accordingly, the lower end portion of the nozzle 142 may be always kept immersed in the decontamination water 141 filling the decontamination tank 140.

Also, the decontamination tank 140 may include an outlet, and the outlet may be provided in an upper portion of the decontamination tank 140. Accordingly, steam which is delivered to the decontamination tank 140 and then is not dissolved in the decontamination water 141 may be discharged to the outside through the outlet.

In this case, steam which is not dissolved in the decontamination water 141 is likely to include radioactive materials. To prevent this, the outlet of the decontamination tank 140 may be connected to filtered venting equipment 150 through a bypass line 183. Accordingly, steam which has passed through the decontamination tank 140 may not be directly released to the atmosphere through the outlet and may pass through the filtered venting equipment 150 and then be released to the outside.

Here, the bypass line 183 may be connected to the in-containment refueling water storage tank 102 provided in the containment building 101 through a venting line 184, and a valve 194 may be provided on the bypass line 183.

As a non-limiting example, the valve 194 may be a three-way valve. Accordingly, steam discharged from the decontamination tank 140 may be moved to the filtered venting equipment 150 or the in-containment refueling water storage tank 102 in the containment building 101 through control of the three-way valve.

In this way, steam discharged from the decontamination tank 140 may be additionally decontaminated from radioactive materials through the filtered venting equipment 150 or the in-containment refueling water storage tank 102.

As a non-limiting example, the valve 194 may be a three-way valve. Accordingly, steam discharged from the decontamination tank 140 may be moved to the filtered venting equipment 150 or the in-containment refueling water storage tank 105 in the containment building 101 through control of the three-way valve.

In this way, steam discharged from the decontamination tank 140 may be additionally decontaminated from radioactive materials through the filtered venting equipment 150 or the in-containment refueling water storage tank 105.

In one embodiment of the present invention, the decontamination tank 140 may be installed outside the containment building 101 as shown in FIGS. 1 and 2.

As another embodiment of the present invention, the decontamination tank 140 may be installed inside the containment building 101 as shown in FIG. 3.

In this case, even when the decontamination tank 140 is partially damaged due to an instantaneous rise in pressure and radioactive materials leak out from the decontamination tank 140, the radioactive materials leaking out from the decontamination tank 140 may be released into the containment building 101 because the decontamination tank 140 for removing radioactive materials of steam flowing in from the steam generator 110 when a severe accident occurs is disposed inside the containment building 101.

Accordingly, the radioactive materials leaking out from the decontamination tank 140 may be held in the containment building 101 and be fundamentally prevented from being released to the outside. Accordingly, the system 300 for reducing the atmospheric release of radioactive materials caused by a severe accident according to one embodiment of the present invention can fundamentally prevent an accident in which radioactive materials are released to the outside by bypassing the containment building 101 when a severe accident occurs, thus improving the safety of a nuclear power plant further.

The depressurizing power generation unit 120 and 130 may generate emergency power while depressurizing steam delivered from the steam generator 110 to the decontamination tank 140 when a severe accident occurs.

To this end, the depressurizing power generation unit 120 and 130 may be disposed on the connection line 182 which connects the main steam line 181 and the decontamination tank 140 as shown in FIGS. 1 to 3.

In this way, high-pressure steam generated from the steam generator 110 may pass the depressurizing power generation unit 120 and 130 through the main steam line 181 and the connection line 182 and then may be moved to the decontamination tank 140.

For example, the depressurizing power generation unit 120 and 130 may include a turbine 120 including a plurality of blades which are rotated by steam delivered from the steam generator 110 and a power generator 130 which generates emergency power through rotation of the turbine 120.

For this reason, high-pressure steam delivered from the steam generator 110 may be depressurized in the process of passing through the turbine 120 and delivered to the decontamination tank 140 in a depressurized state.

Accordingly, since instantaneously high-pressure steam is prevented from being supplied from the steam generator 110 to the decontamination tank 140, a risk that the decontamination tank 140 will be damaged by high-pressure steam may be reduced.

That is, high-pressure steam supplied from the steam generator 110 to the depressurizing power generation unit 120 and 130 may be depressurized in the process of passing through the depressurizing power generation unit 120 and 130 and reduced in momentum, and the steam reduced in momentum is supplied to the decontamination tank 140 so that the decontamination tank 140 may be prevented from being damaged by high-pressure steam.

In this way, the systems 100, 200, and 300 for reducing the atmospheric release of radioactive materials caused by a severe accident according to one embodiment of the present invention can improve the stability of the decontamination tank 140.

Accordingly, the systems 100 and 200 for reducing the atmospheric release of radioactive materials caused by a severe accident according to one embodiment of the present invention can prevent the decontamination tank 140 from being damaged by high-pressure steam even when the decontamination tank 140 for reducing the release of radioactive materials is disposed outside the containment building 101 as shown in FIGS. 1 and 2. Consequently, it is possible to prevent a bypass accident in which radioactive materials are released to the atmosphere in the outside of the containment building 101.

Also, in the system 300 for reducing the atmospheric release of radioactive materials caused by a severe accident according to one embodiment of the present invention as shown in FIG. 3, in a case in which the decontamination tank 140 for reducing the release of radioactive materials is disposed inside the containment building 101 of, even if the decontamination tank 140 is partially damaged by high-pressure steam, radioactive materials leaking out from the decontamination tank 140 may be prevented from being released to the outside of the containment building 101 so that a bypass accident, in which radioactive materials are released, can be fundamentally prevented.

In addition, the systems 100, 200, and 300 for reducing the atmospheric release of radioactive materials caused by a severe accident according to one embodiment of the present invention may generate emergency power through the depressurizing power generation unit 120 and 130 using high-pressure steam delivered from the steam generator 110.

Accordingly, the systems 100, 200, and 300 for reducing the atmospheric release of radioactive materials caused by a severe accident according to one embodiment of the present invention can monitor the internal state of the containment building 101 using emergency power generated by the depressurizing power generation unit 120 and 130 even when a severe accident occurs and power supplied from the outside is cut off.

To this end, the systems 100, 200, and 300 for reducing the atmospheric release of radioactive materials caused by a severe accident according to one embodiment of the present invention may include at least one sensor 160 which is installed in the containment building 101 to sense the internal state of the containment building 101. The at least one sensor 160 may use emergency power generated by the depressurizing power generation unit 120 and 130 as drive power.

Here, the at least one sensor 160 may be any of various well-known sensors, such as a temperature sensor, a water level sensor, and a pressure sensor, for sensing the internal state of a containment building.

Accordingly, the systems 100, 200, and 300 for reducing the atmospheric release of radioactive materials caused by a severe accident according to one embodiment of the present invention can operate various pieces of electrical equipment installed in the containment building 101 using emergency power generated by the depressurizing power generation unit 120 and 130 even when a severe accident occurs in the containment building 101 and power supply is stopped. For this reason, the systems 100, 200, and 300 for reducing the atmospheric release of radioactive materials caused by a severe accident according to one embodiment of the present invention make it possible to rapidly grasp the initial state of a severe accident and rapidly take an appropriate countermeasure.

In one embodiment of the present invention, the depressurizing power generation unit 120 and 130 may be installed outside the containment building 101 together with the decontamination tank 140 as shown in FIG. 1. In this case, one end of the connection line 182 may be connected to the decontamination tank 140, and the other end may be connected to the main steam safety valve 192 installed on the main steam line 181.

As another embodiment of the present invention, the depressurizing power generation unit 120 and 130 may be installed inside the containment building 101 as shown in FIG. 2, and the decontamination tank 140 may be installed outside the containment building 101.

In this case, one end of the connection line 182 connecting the main steam line 181 and the decontamination tank 140 may be connected to the decontamination tank 140, and the other end may be connected to the main steam safety valve 192 installed on the main steam line 181. In addition, a part of the connection line 182 may be disposed to locate inside the containment building 101, and the depressurizing power generation unit 120 and 130 may be installed at the part of the connection line 182 disposed inside the containment building 101.

In this way, it is possible to conveniently perform cable (not shown) wiring work for providing power generated by the depressurizing power generation unit 120 and 130 to the at least one sensor 160.

As still another embodiment of the present invention, the depressurizing power generation unit 120 and 130 may be installed inside the containment building 101 together with the decontamination tank 140 as shown in FIG. 3.

In this case, one end of the connection line 182 connecting the main steam line 181 and the decontamination tank 140 may be connected to the decontamination tank 140, and the other end may be connected to the atmospheric release reduction valve 195 installed on the main steam line 181. In addition, the connection line 182 may be disposed to locate inside the containment building 101, and the depressurizing power generation unit 120 and 130 may be installed on the connection line 182.

In this way, it is possible to conveniently perform cable (not shown) wiring work for providing power generated by the depressurizing power generation unit 120 and 130 to the at least one sensor 160.

Meanwhile, the systems 100, 200, and 300 for reducing the atmospheric release of radioactive materials caused by a severe accident according to one embodiment of the present invention may further include a cooling unit 144. As shown in FIG. 4, the cooling unit 144 may be disposed to surround the exterior of the decontamination tank 140. Accordingly, the cooling unit 144 may cool the decontamination tank 140.

That is, the cooling unit 144 may sufficiently condense steam flowing into the decontamination tank 140 by reducing pressure and temperature in the decontamination tank 140 through cooling. In this way, it is possible to prevent the decontamination tank 140 from being damaged by a dynamic load.

Here, the cooling unit 144 may be installed outside the decontamination tank 140 and may be in the form of a water tank. Also, the cooling unit 144 may include at least one cooling fin to improve its external cooling performance and may be filled with firefighting water or the like.

Meanwhile, the present invention may provide a method for reducing the atmospheric release of radioactive materials caused by a severe accident.

For example, the method may be implemented by using the above-described systems 100, 200, and 300 for reducing the atmospheric release of radioactive materials caused by a severe accident.

Figure 5:
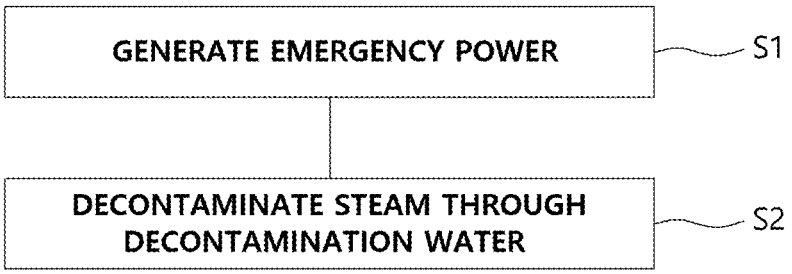
FIG. 5 is a flowchart illustrating a method of reducing the atmospheric release of radioactive materials caused by a severe accident according to one embodiment of the present invention.

That is, as shown in FIG. 5, the method for reducing the atmospheric release of radioactive materials caused by a severe accident according to one embodiment of the present invention may include an operation S1 of generating emergency power and an operation S2 of decontaminating steam through decontamination water.

The operation S1 of generating emergency power may both depressurize steam delivered from the steam generator 110 disposed in the containment building 101 to the decontamination tank 140 and generate emergency power using the steam.

This may be performed as described above by the depressurizing power generation unit 120 and 130 provided on the connection line 182, and the emergency power may be generated through another turbine 120 which is disposed on the connection line 182 connected to the main steam line 181 connecting the turbine (not shown) for nuclear power generation and the steam generator 110.

Here, the emergency power generated through the depressurizing power generation unit 120 and 130 as described above, may be used as drive power of electrical equipment which uses electricity in the containment building 101.

In addition, the operation S2 of decontaminating steam through decontamination water may be performed through the decontamination water 141 in the decontamination tank 140. Here, the operation S2 of decontaminating steam through decontamination water may condense water vapor in mixed gas delivered to the decontamination tank 140, or remove radioactive materials or hydrogen from the mixed gas delivered to the decontamination tank 140.

That is, in the operation S2 of decontaminating steam through decontamination water, water vapor in the mixed gas delivered from the depressurizing power generation unit 120 and 130 is condensed, and fission products are removed from the mixed gas, so that the possibility of explosion may be lowered.

Meanwhile, the method of reducing the atmospheric release of radioactive materials caused by a severe accident according to one embodiment of the present invention may further include an operation of cooling the mixed gas decontaminated in the decontamination tank 140 and an operation of adjusting pressure. The cooling and pressure adjustment may be performed by using the cooling unit 144 which is disposed to surround the exterior of the decontamination tank 140 and cools the decontamination tank 140.

In addition, the method of reducing the atmospheric release of radioactive materials caused by a severe accident according to one embodiment of the present invention may further include an operation of discharging steam decontaminated through the decontamination tank 140.

Here, steam decontaminated in the operation of discharging steam decontaminated through the decontamination tank 140 may be directly discharged to the atmosphere through the outlet of the decontamination tank 140, delivered to the filtered venting equipment 150 through the bypass line 183 connecting the decontamination tank 140 and the filtered venting equipment 150, or delivered to the in-containment refueling water storage tank 102 disposed in the containment building 101.

Although exemplary embodiments of the present invention have been described above, the spirit of the present invention is not limited to the embodiments set forth herein. Those of ordinary skill in the art who understand the spirit of the present invention may easily propose other embodiments through supplement, change, removal, addition, etc. of elements within the same spirit, and the embodiments will be also within the scope of the present invention.

What is claimed is:

1. A system for reducing the atmospheric release of radioactive materials caused by a severe accident, the system comprising:

a steam generator disposed in a containment building, configured to generate steam by using heat of a coolant heated in a nuclear reactor, connected to a main steam line and supplying the steam through the main steam line;

a decontamination tank connected to the steam generator through the main steam line and a connection line and containing decontamination water for decontaminating the steam delivered from the steam generator and released into the atmosphere for reducing the atmospheric release of radioactive materials when a severe accident occurs; and a depressurizing power generation unit disposed on the connection line and configured to generate emergency power while depressurizing the steam delivered from the steam generator toward the decontamination tank when the severe accident occurs.

2. The system of claim 1, wherein the depressurizing power generation unit comprises:

a turbine including a plurality of blades rotated by the steam delivered from the steam generator; and a power generator configured to generate power through rotation of the turbine.

3. The system of claim 1, wherein the depressurizing power generation unit and the decontamination tank are disposed outside the containment building.

4. The system of claim 1, wherein the depressurizing power generation unit is disposed inside the containment building, and the decontamination tank is disposed outside the containment building.

5. The system of claim 1, wherein the depressurizing power generation unit and the decontamination tank are disposed inside the containment building.

6. The system of claim 1, wherein the severe accident is a steam generator tube rupture or an interfacing-system loss-of-coolant-accident.

7. The system of claim 1, wherein the decontamination tank includes at least one nozzle provided at an end of the connection line.

8. The system of claim 1, further comprising filtered venting equipment connected to an outlet of the decontamination tank through a bypass line.

9. The system of claim 1, further comprising a cooling unit disposed to surround an exterior of the decontamination tank and configured to cool the decontamination tank.

10. The system of claim 1, wherein at least one sensor for checking an internal state of the containment building when the severe accident occurs is disposed inside the containment building.

11. The system of claim 10, wherein the at least one sensor is operated with the emergency power generated by the depressurizing power generation unit.

* * * * *